US010581149B2

(12) United States Patent
Xu et al.

(10) Patent No.: US 10,581,149 B2
(45) Date of Patent: Mar. 3, 2020

(54) ELECTRONIC DEVICE AND SUBSTRATE WITH LDS ANTENNAS AND MANUFACTURING METHOD THEREOF

(71) Applicant: FOXCONN INTERCONNECT TECHNOLOGY LIMITED, Grand Cayman (KY)

(72) Inventors: Xuan Xu, Kunshan (CN); Ye Xiong, Kunshan (CN); Yuan-Zi Duan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/922,933

(22) Filed: Mar. 16, 2018

(65) Prior Publication Data

US 2018/0269568 A1 Sep. 20, 2018

(30) Foreign Application Priority Data

Mar. 16, 2017 (CN) ..... 2017 1 0156418

(51) Int. Cl.
*H01Q 1/38* (2006.01)
*H01Q 21/28* (2006.01)
*H01Q 1/24* (2006.01)

(52) U.S. Cl.
CPC ..... *H01Q 1/38* (2013.01); *H01Q 1/243* (2013.01); *H01Q 21/28* (2013.01)

(58) Field of Classification Search
CPC ..... H01Q 1/38; H01Q 1/243; H01Q 21/28; H01Q 1/40; H01Q 1/36; H01Q 1/44
See application file for complete search history.

(56) References Cited

U.S. PATENT DOCUMENTS

2014/0111684 A1* 4/2014 Corbin ..... H01Q 1/243 348/374
2014/0125551 A1* 5/2014 Chen ..... H01Q 1/243 343/878

(Continued)

FOREIGN PATENT DOCUMENTS

CN 104466370 A 3/2015
CN 104953270 A 9/2015

(Continued)

*Primary Examiner* — Dameon E Levi
*Assistant Examiner* — David E Lotter
(74) *Attorney, Agent, or Firm* — Wei Te Chung; Ming Chieh Chang

(57) ABSTRACT

An electronic device includes a substrate with a plurality of LDS antennas and a conductive member, the substrate defines a first surface and a second surface opposite to the first surface. A decorative ink layer coats to the first surface of the substrate facing the interior of the electronic device, several LDS ink layers coat to the decorative ink layer, the LDS antennas are disposed on the corresponding LDS ink layers. The LDS antenna defines feed-in portion connecting with the conductive member, the conductive member comprises a flexible printed circuit and an anisotropic conductive adhesive connecting the flexible printed circuit and feed-in portion. Therefore, the transmission and reception of signal data can be realized through the connection between the flexible print circuit and the LDS antenna thereby enhance the effect of signal transmission and meet the needs of flexibility and miniaturization.

4 Claims, 7 Drawing Sheets

(56) References Cited

U.S. PATENT DOCUMENTS

| | | | | |
|---|---|---|---|---|
| 2016/0344089 | A1* | 11/2016 | Baik | G04G 21/04 |
| 2017/0095889 | A1* | 4/2017 | Bishop | H01Q 1/243 |

FOREIGN PATENT DOCUMENTS

| | | | |
|---|---|---|---|
| CN | 105186101 | A | 12/2015 |
| CN | 105472889 | A | 4/2016 |
| CN | 205335414 | U | 6/2016 |
| CN | 205355245 | U | 6/2016 |
| TW | 201639631 | A | 11/2016 |

* cited by examiner

ELECTRONIC DEVICE AND SUBSTRATE WITH LDS ANTENNAS AND MANUFACTURING METHOD THEREOF

1. FIELD OF THE DISCLOSURE

The invention is related to an electronic device with corresponding substrate including a plurality of LDS (Laser Direct Structuring) antennas.

2. DESCRIPTION OF RELATED ARTS

Wireless communication functions have been increasingly integrated into modern electronic device, the antennas are also increasingly used in electronic devices as an essential component of wireless communication. With the development of miniaturization and aesthetics of electronic devices and the advances in antenna technology, more and more antennas have been built into electronic devices. In the prior art, an antenna is usually manufactured by using a method for manufacturing a printed circuit board, and a desired antenna shape is manufactured by using etching or laser techniques and so on.

Laser direct structuring technology refers to make computer to control the movement of the laser in accordance with the trajectory of the conductive pattern, the laser is projected onto a molded three-dimensional plastic device to activate the circuit pattern within a few seconds. For the design and production of antennas of mobile phone, it refers to directly plate the antenna on a plastic support through the laser molded technology. China Utility Patent No. CN104953270 discloses a manufacturing method of an LDS antenna, which includes an LDS coating applied on the surface of the back glass coat facing the inside of the main body, the LDS antenna is connecting with the print circuit board, however, it directly coats the surface of the substrate with the LDS coating, which is not conducive to saving space and cost, and it is easy to cause misalignment of the antenna during the process of plating the antenna. A saving space and simple structure is desired.

SUMMARY OF THE DISCLOSURE

An object of the invention is to provide an electronic device includes a substrate with a plurality of LDS antennas and a conductive member, the substrate defines a first surface and a second surface opposite to the first surface. A decorative ink layer coats to the first surface of the substrate facing the interior of the electronic device, several LDS ink layers coat to the decorative ink layer, the LDS antennas are disposed on the corresponding LDS ink layers. The LDS antenna defines feed-in portion connecting with the conductive member, the conductive member comprises a flexible printed circuit and an anisotropic conductive adhesive connecting the flexible printed circuit and feed-in portion. Therefore, the transmission and reception of signal data can be realized through the connection between the flexible print circuit and the LDS antenna thereby enhance the effect of signal transmission and meet the needs of flexibility and miniaturization.

DETAILED DESCRIPTION OF THE PREFERRED EMBODIMENT

Referring to FIGS. 1-7, an electronic device 100 includes a substrate 1 with a plurality of LDS antennas 3 and a conductive member 2, the conductive member 2 and the LDS antennas 3 are electrically connected to realize the transmission of signal data. The electronic device 100 referers to be a mobile phone, a compute or a device may be matched with the substrate 1.

Figure 1:
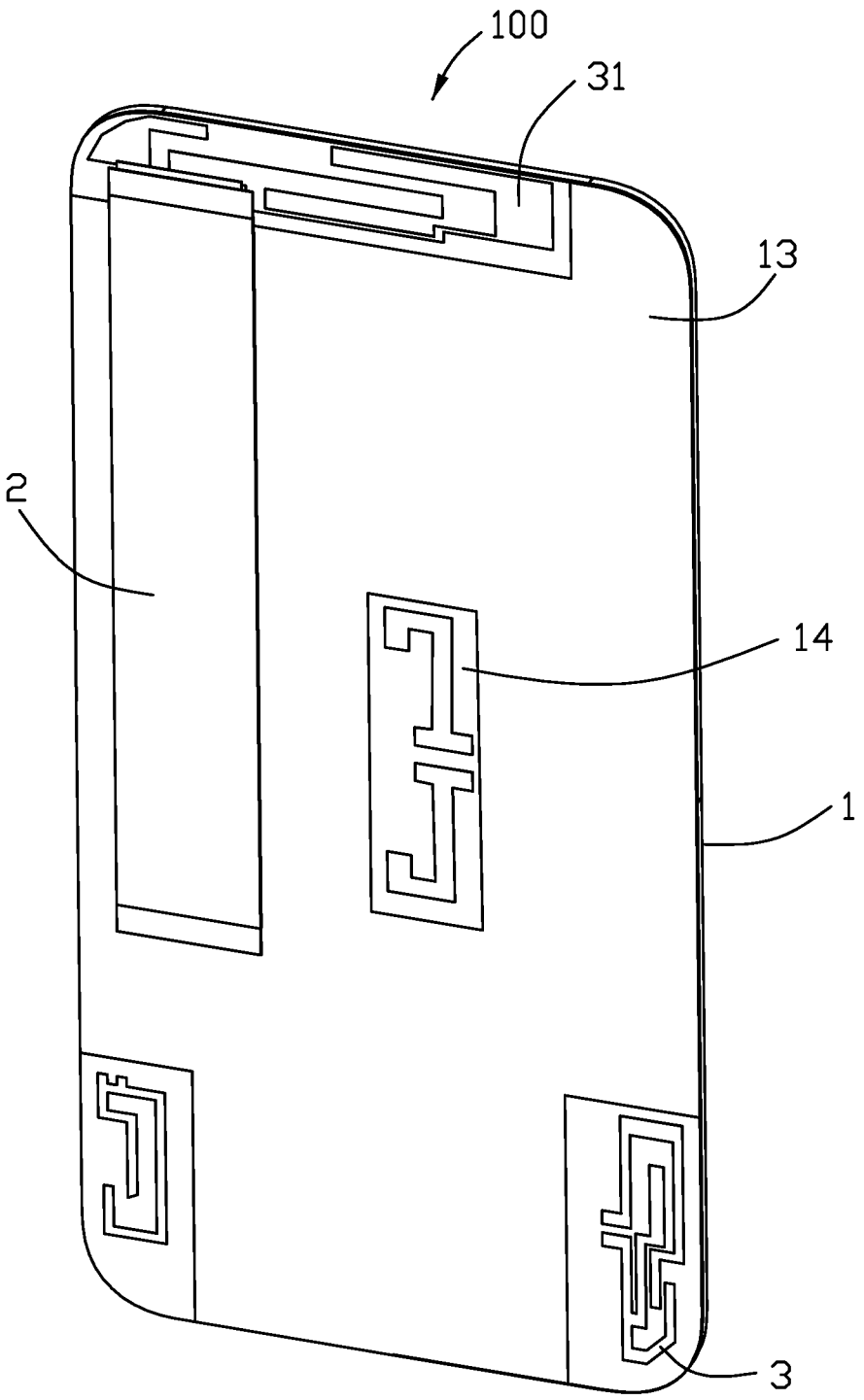
FIG. 1 is a perspective view of electronic device according to the invention.
Figure 2:
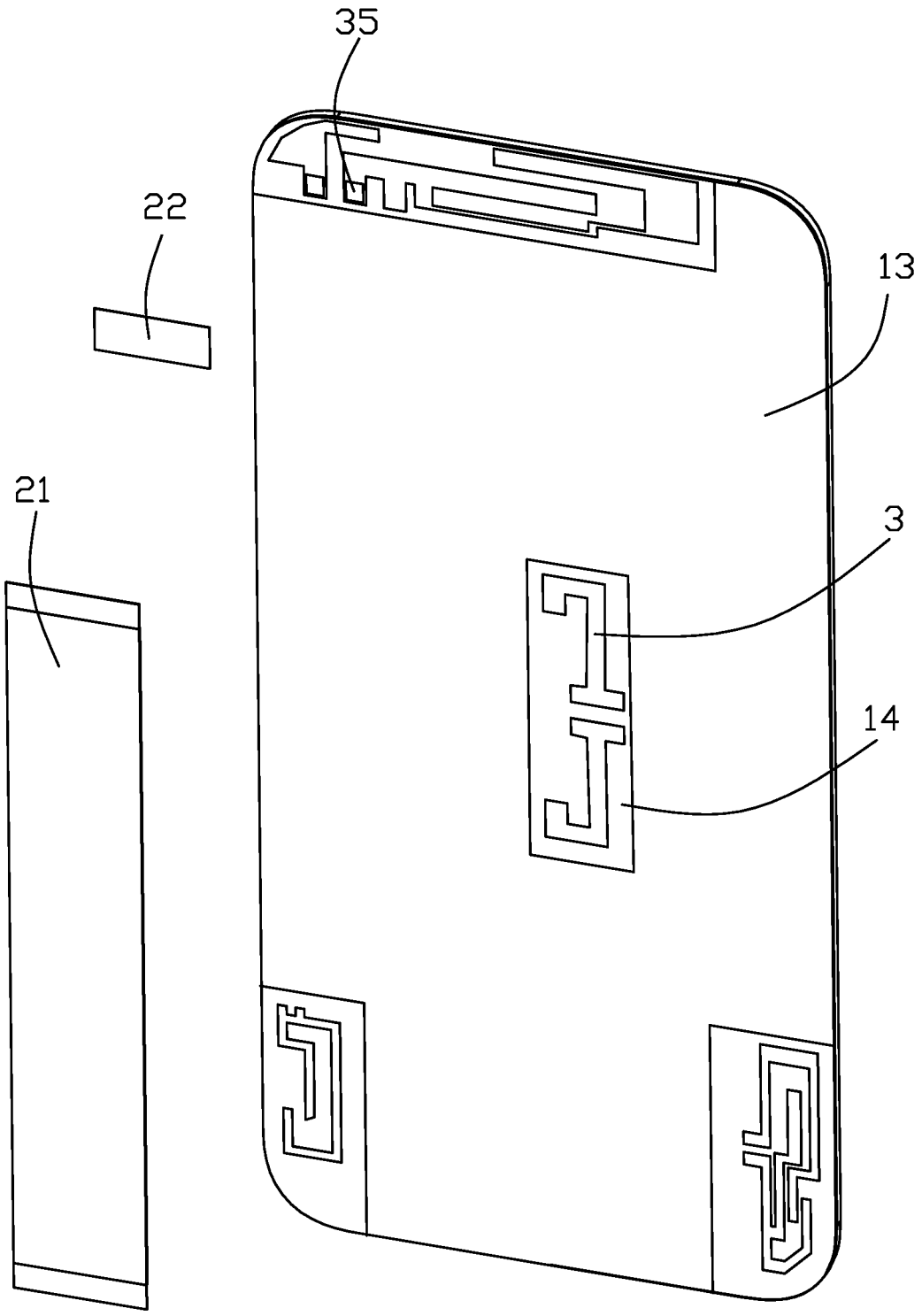
FIG. 2 is a perspective view of electronic device removing the conductive member of FIG. 1.
Figure 3:
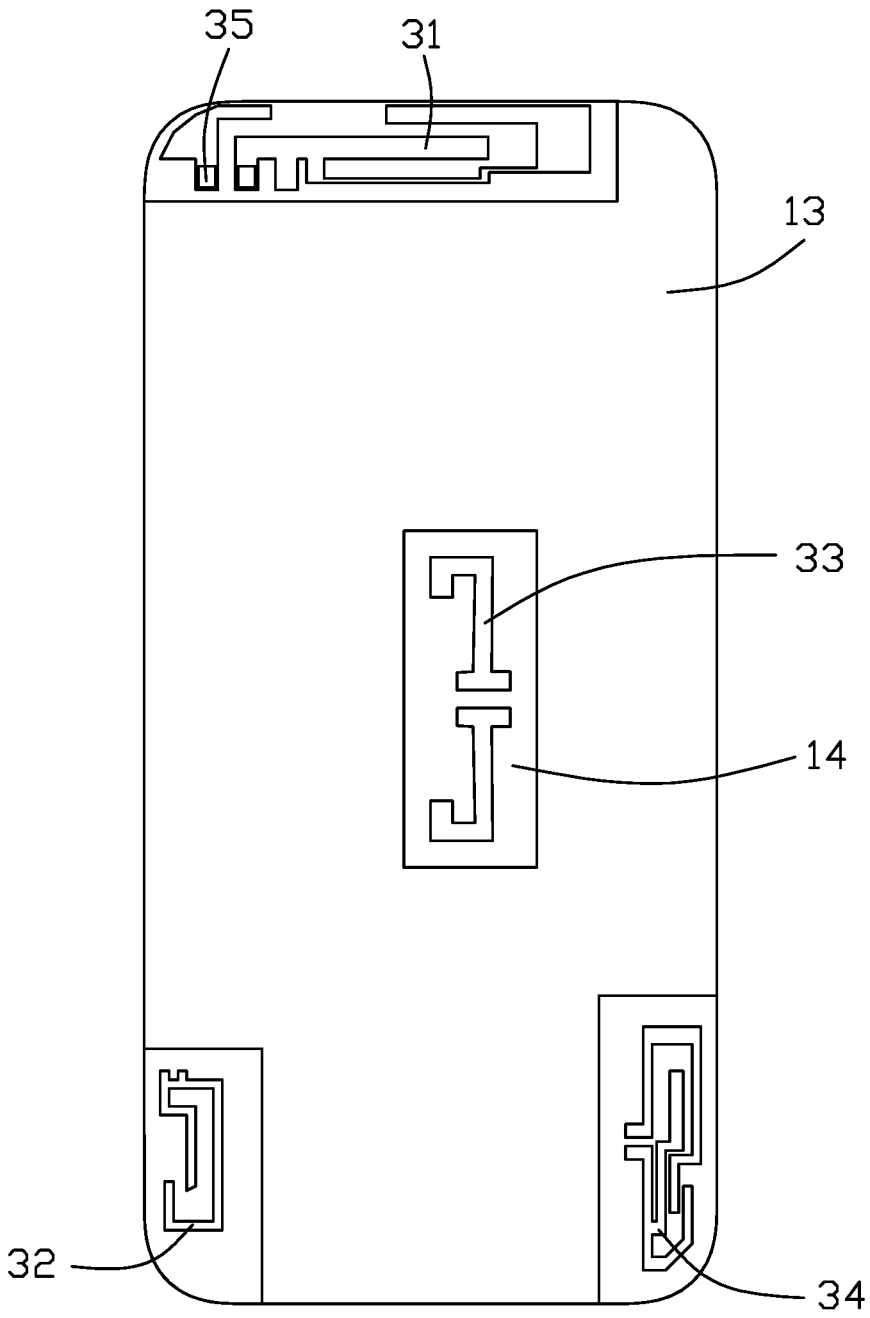
FIG. 3 is a top view of the substrate with LDS antennas after the electronic device removes the conductive member of FIG. 1.
Figure 4:
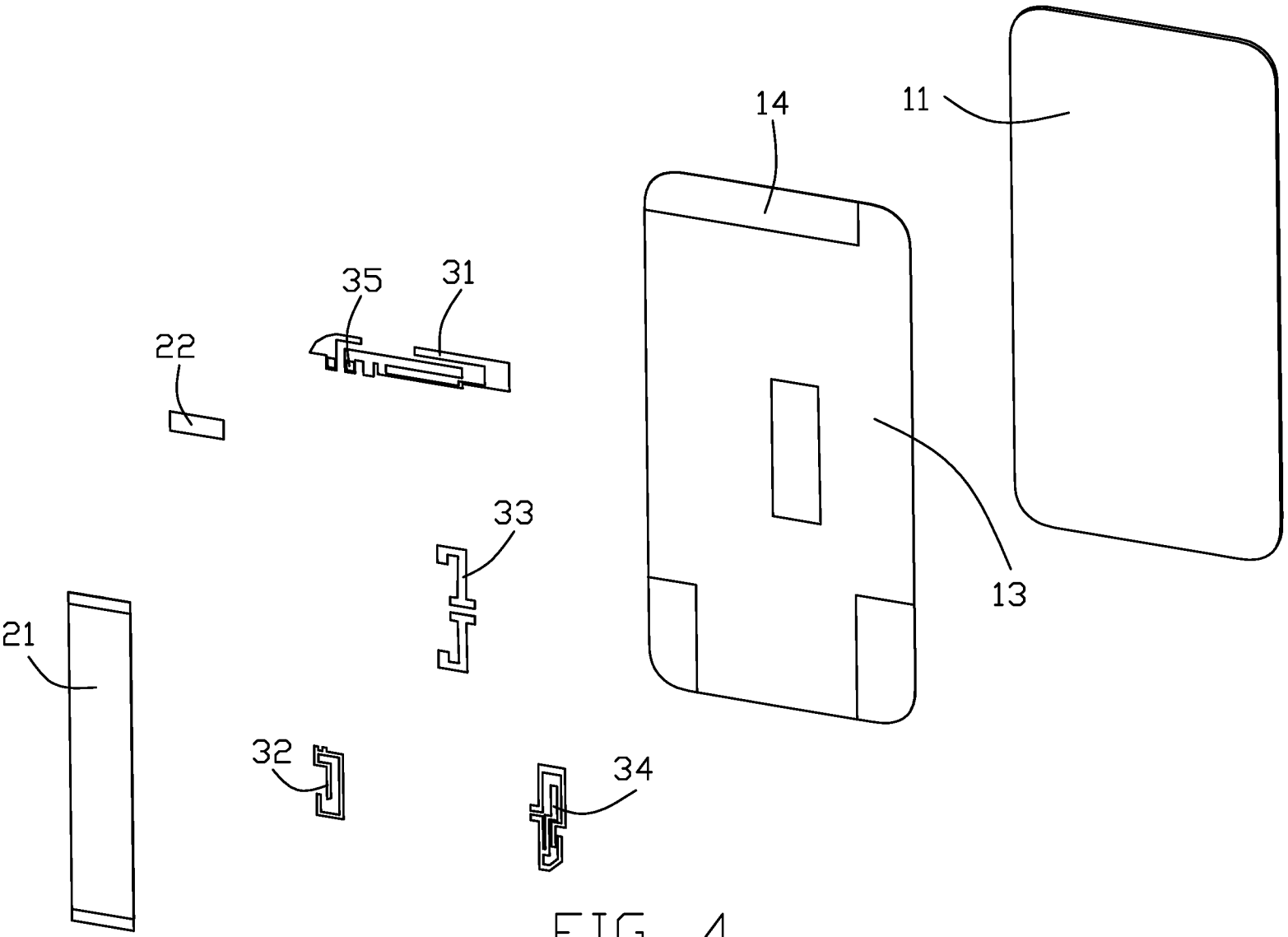
FIG. 4 is an exploded perspective view of the electronic device of FIG. 1.
Figure 5:
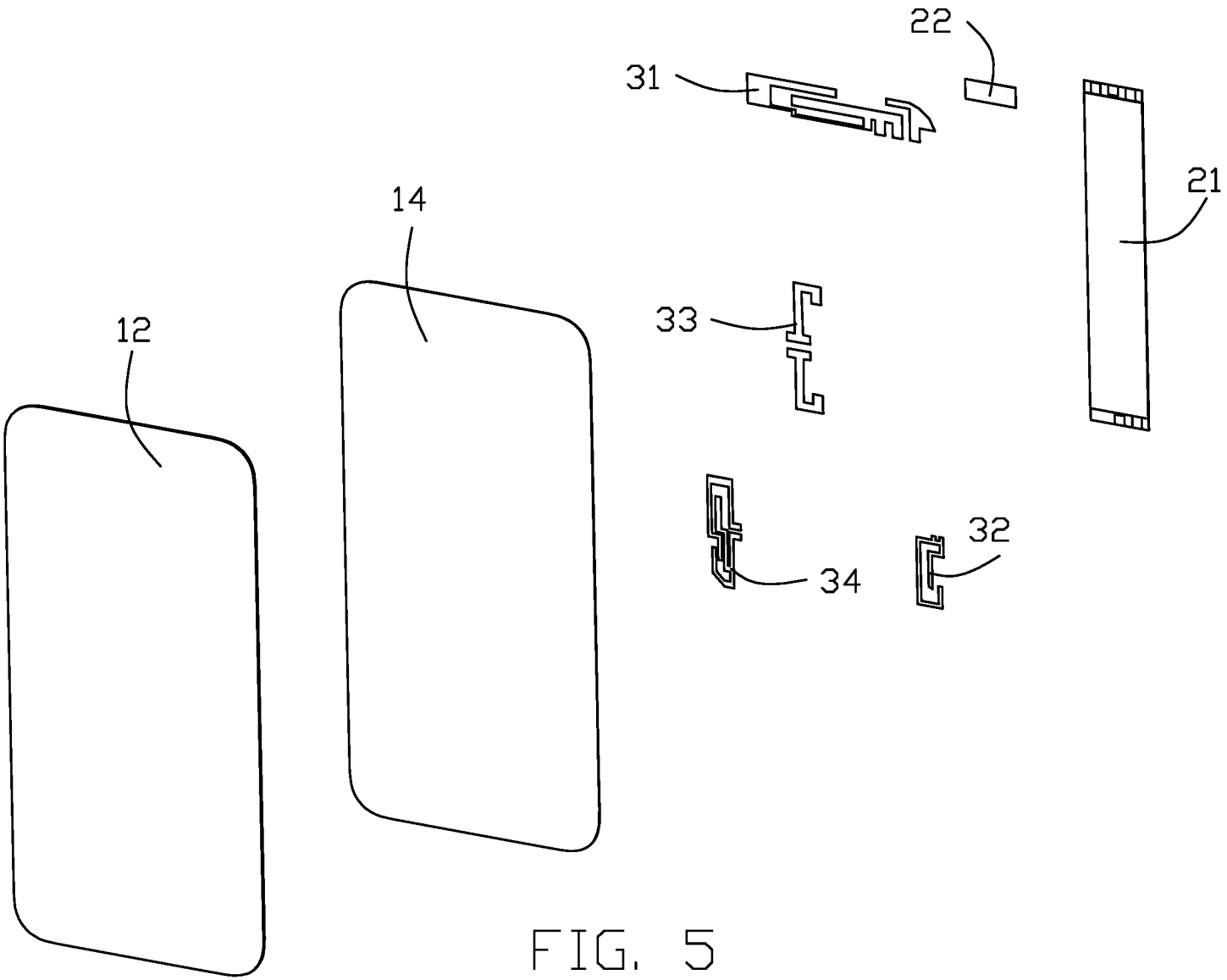
FIG. 5 is another exploded perspective view of the electronic device of FIG. 10.
Figure 6:
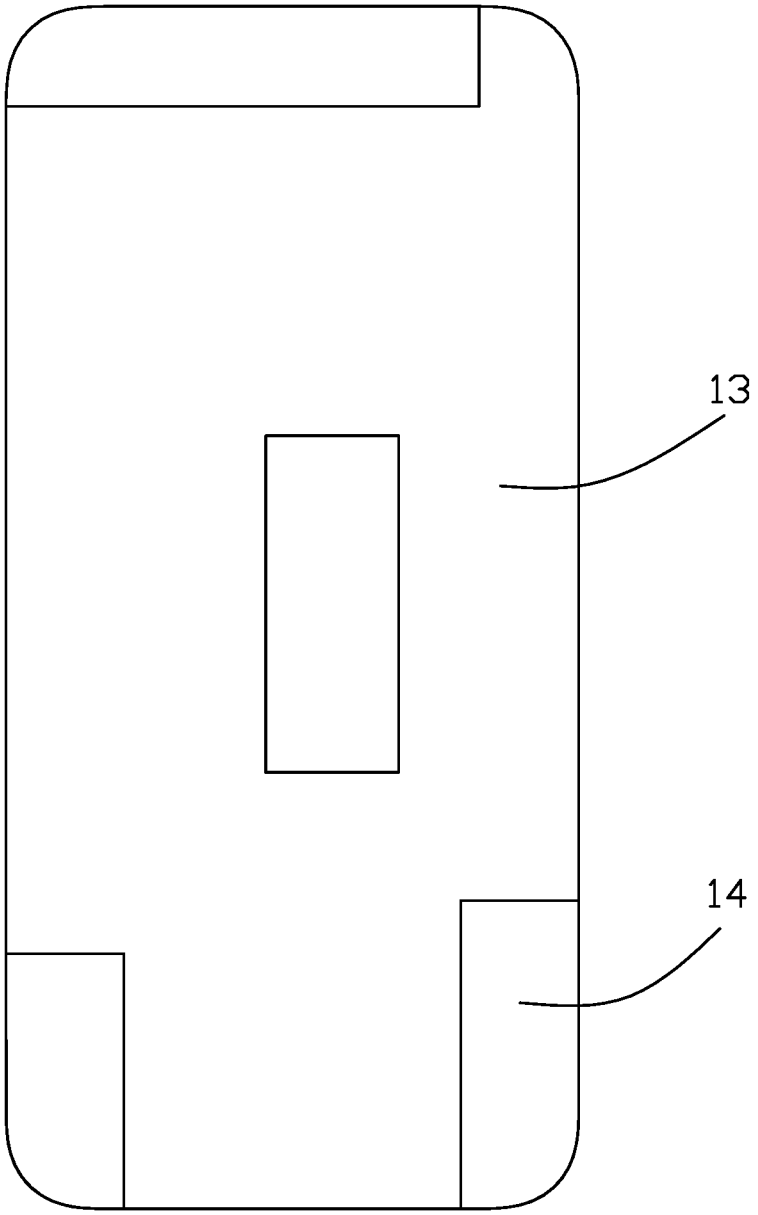
FIG. 6 is a perspective view after the LDS antenna removed from the substrate of FIG. 3.
Figure 7:
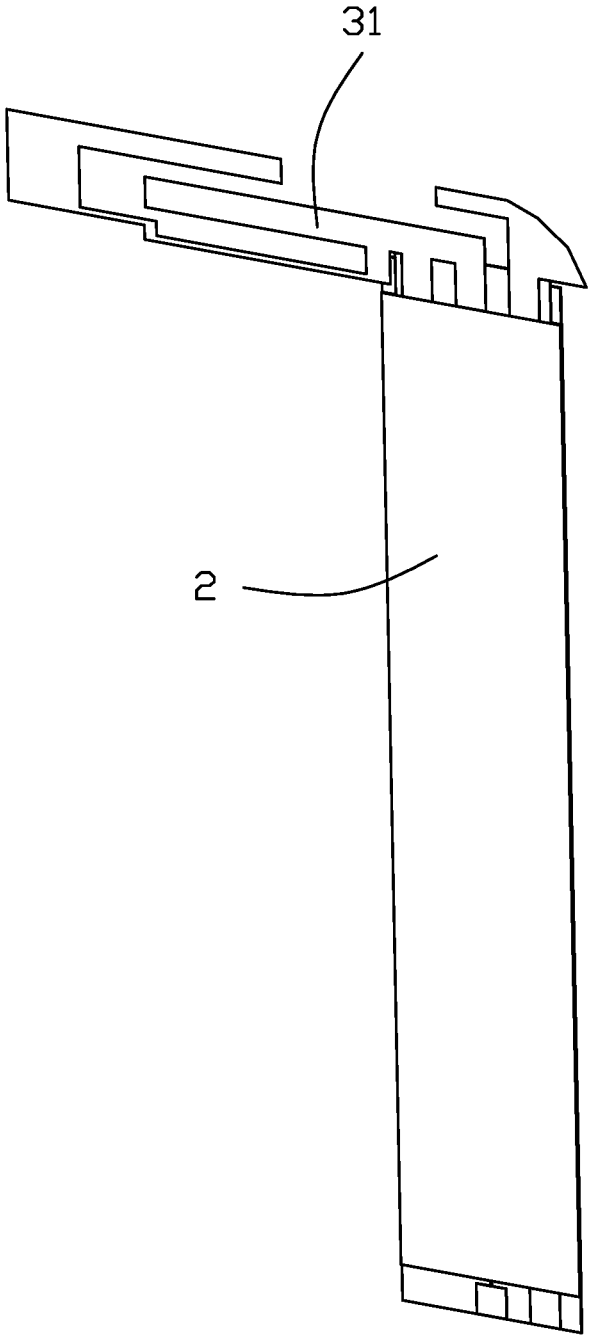
FIG. 7 is a perspective view of the conductive member of FIG. 1.

Referring to FIGS. 4-5, the substrate 1 defines a first surface 11 and a second surface 12 opposite to the first surface 11, the first surface 11 is facing the interior of the electronic device 100, the substrate 1 performs a certain thickness, and the drawings are only for simplified illustration. A decorative ink layer 13 coats to the first surface 11 of the substrate 1, the decorative ink layer 13 coats the entire first surface 11 of the substrate 1 so that the decorative ink layer 13 conforms to the shape of the substrate 1, and the decorative ink layer 13 may paint message such as product identification. The decorative ink layer 13 further has a set of LDS ink layers 14 coated on specific places thereof. In fact, the LDS ink layer 14 is a mixture of metal catalyst additives and ink, each substrate 1 includes four LDS ink layers 14 performed a rectangular pattern, and the LDS antennas 3 are formed in internal regions of the rectangular patterns. One LDS ink layer 14 is disposed on the center of the substrate 1, another two LDS ink layers 14 are disposed on two corners of one end of the substrate 1, the other LDS ink layer 14 is disposed on the other end of the substrate 1, the LDS antennas 3 are lased and coated on the four corresponding LDS ink layers 14. The LDS antennas 3 include one or more of a main antenna, a GPS antenna, a WIFI antenna, an NFC antenna, or a diversity antenna. Specifically, the LDS antenna 3 includes a main antenna 31, a GPS antenna 32, a WIFI antenna 33, and a diversity antenna 34 to meet the various signal transmission requirements of electronic devices 100.

Referring to FIGS. 4-5, the conductive member 2 includes a flexible print circuit 21 locating at the foreside of the substrate 1 and an anisotropic conductive adhesive 22, one LDS antenna 3 defines a signal feed-in portion 35 connecting with the conductive member 2, the anisotropic conductive adhesive 22 electrically connects the signal feed-in portion 35 and the flexible print circuit 21. In the drawing, only the arrangement of the conductive member 2 on the main antenna 31 is illustrated, essentially, the GPS antenna 32, the WIFI antenna 33, and the diversity antenna 34 are electrically connecting with the flexible print circuit 21 though the anisotropic conductive adhesive 22 to achieve the transmission of signal data, the size of the conductive member 2 is much larger than each LDS ink layer 14, and the conductive member 2 is parallel to one of LDS ink layers 14. Preferably, the substrate 1 is made from a transparent material, the decorative ink layer 13 can be coated with a desired color, and the LDS ink layers 14 are coated to the first surface 11 through the decorative ink layer 13 so that the specific shape of the LDS antennas 3 can not be seen along the second surface 12 toward to the first surface 11.

In this way, the electronic device 100 includes a decoration ink layer 13 and several LDS ink layers 14 on the substrate 1, and then the LDS antenna 3 is formed on the LDS ink layer 14 using laser direct structuring technology so that the stability of the LDS antenna 3 can be enhanced and the materials can be saved. In the case that the electronic device 100 needs to matched with multiple antennas, the configuration of the LDS ink layer 14 can be matched with the state of the antennas, so that the pattern of the LDS antenna 3 can be laser-lighted simply and conveniently, thereby improving the efficiency of manufacturing process and optimizing the performance of product. Furthermore, the transmission and reception of signal data can be realized through the connection between the flexible print circuit 21 and the LDS antenna 3 thereby enhance the effect of signal transmission and meet the needs of flexibility and miniaturization.

The manufacturing process of the substrate 1 with a plurality of LDS antennas 3 includes the following steps: first step, providing a substrate 1 defining a first surface 11 and a second surface 12 opposite to the first surface 11; second step, providing a decorative ink layer 13 coating all the first surface 11; third step, providing four LDS ink layers 14 coating to the surface of the decorative ink layer 13; forth step, using the laser direct structuring technology to form an antenna pattern on the LDS ink layers 14. In the second step, the decorative ink layer 13 is molded on the first surface 11 of the substrate 1 by screen printing or spraying; in the third step, the four LDS ink layers 14 are molded to the decorative ink layer 13 by printing or spraying, each LDS ink layer 14 is a mixture of metal catalyst additives and ink; in the forth step, the four LDS ink layers 14 are lased before the LDS antennas 3 pattern is coated, the pattern of the LDS antennas 3 is further plated by chemical copper or chemical nickel syrup after the forth step.

The manufacturing process of the substrate 1 with LDS antennas 3 according to the present invention is simpler and easier to operate than the conventional LDS antenna, and firstly, it forms a decoration ink layer 13 on the surface of the substrate 1, then forming the LDS ink layers 14 to the decorative ink 13 according to the specific state of the antennas. Not only the manufacturing process is more precise and the signal transmission more stable, but also can not make the areas where there are not need antennas to perform the laser activation and plating process, thereby avoiding the waste of raw materials to improve the performance of signal transmission of the antenna area and better adapt to the situation that the urgent need for a simple manufacture process of antenna with the increasing of antenna number.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. A substrate with a plurality of LDS antennas comprising:

a first surface coated with a decorative ink layer; and a second surface opposite to the first surface;

wherein the decorative ink layer further has a set of LDS ink layers coated on specific places thereof, and the LDS antennas are formed on the corresponding LDS ink layers using laser direct structuring technology; wherein the decorative ink layer are coated on the entire first surface of the substrate, the LDS ink layer present as a rectangular pattern, and the LDS antennas are formed in internal regions of the rectangular patterns; wherein each substrate includes four LDS ink layers, one LDS ink layer is disposed on the center of the substrate, another two LDS ink layers are disposed on two corners of one end of the substrate, the other LDS ink layer is disposed on the other end of the substrate.

2. The substrate as claimed in claim 1, wherein the LDS ink layer is a mixture of the metal catalyst additives and ink.

3. The substrate as claimed in claim 1, wherein the LDS antennas includes one or more of a main antenna, a GPS antenna, a WIFI antenna, an NFC antenna, or a diversity antenna.

4. An electronic device comprising: a substrate with a plurality of LDS antennas; and a conductive member connecting to the plurality of LDS antennas; wherein the substrate defines a first surface facing the interior of the electronic device, the first surface of the substrate is coated with a decorative ink layer, the surface of the decorative ink layer is coated with several LDS ink layers, the LDS antennas are corresponding disposed on the LDS ink layers, the plurality of LDS antennas define a signal feed-in portion connecting with the conductive member; wherein the conductive member includes a flexible print circuit locating at the inside of the substrate and an anisotropic conductive adhesive electrically connecting the signal feed-in portion and the flexible print circuit; wherein the size of the conductive member is larger than each LDS ink layer, and the conductive member is parallel with one of LDS ink layers.

* * * * *